US009176447B2

(12) United States Patent
Osada et al.

(10) Patent No.: US 9,176,447 B2
(45) Date of Patent: Nov. 3, 2015

(54) IMAGE FORMING APPARATUS

(71) Applicant: Konica Minolta, Inc., Chiyoda-ku (JP)

(72) Inventors: Morio Osada, Toyokawa (JP); Tetsuo Sano, Tachikawa (JP); Junji Murauchi, Toyokawa (JP); Tomohisa Yoshida, Toyokawa (JP); Masanori Kawada, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/619,668

(22) Filed: Feb. 11, 2015

(65) Prior Publication Data

US 2015/0253713 A1 Sep. 10, 2015

(30) Foreign Application Priority Data

Mar. 4, 2014 (JP) ..... 2014-041604

(51) Int. Cl.
*G03G 15/00* (2006.01)

(52) U.S. Cl.
CPC ..... *G03G 15/5033* (2013.01); *G03G 15/5041* (2013.01)

(58) Field of Classification Search
None
See application file for complete search history.

(56) References Cited

U.S. PATENT DOCUMENTS

2006/0292480 A1* 12/2006 Niimi ..... 430/124
2008/0025767 A1* 1/2008 Takagami ..... 399/313

FOREIGN PATENT DOCUMENTS

JP 2003-287409 A 10/2003

* cited by examiner

*Primary Examiner* — Clayton E LaBalle
*Assistant Examiner* — Jas Sanghera
(74) *Attorney, Agent, or Firm* — Buchanan Ingersoll & Rooney PC

(57) ABSTRACT

An image forming apparatus includes a photoreceptor rotatable about an axis, and having a surface with a photosensitive layer abraded during use, a charging unit configured to charge the surface of the photoreceptor, an exposure unit configured to form an electrostatic latent image on the surface of the photoreceptor, a developing unit configured to form a toner image on the surface of the photoreceptor, and a control unit configured to obtain a film thickness of the photosensitive layer for each of a plurality of different positions in a direction of a rotation axis of the photoreceptor, and perform abrasion operation at a first or second position of the plurality of positions, when a difference in film thickness between the first position and the second position exceeds a predetermined reference value.

6 Claims, 11 Drawing Sheets

IMAGE FORMING APPARATUS

The entire disclosure of Japanese Patent Application No. 2014-041604 filed on Mar. 4, 2014 including description, claims, drawings, and abstract are incorporated herein by reference in its entirety.

BACKGROUND OF THE INVENTION

1. Field of the Invention

The present invention relates to an image forming apparatus for forming a toner image on a photoreceptor.

2. Description of the Related Art

As is well known, there are various kinds of image forming apparatuses, but among them, an electrophotographic image forming apparatus has an imaging unit configured to perform the following process. First, a photoreceptor having been charged is irradiated with light modulated by image data to form an electrostatic latent image on the surface of the photoreceptor. Next, a developer (i.e., toner) is supplied to the electrostatic latent image on the surface of the photoreceptor, and a toner image is formed on the surface of the photoreceptor. The toner image formed according to the above-mentioned process is transferred on a paper sheet. Then, a toner image on the paper sheet is fixed, and printed matter is completed. Further, after the toner image is transferred, a cleaning unit removes the toner remaining on the surface of the photoreceptor.

Repeated printing repeats formation of the toner image and cleaning, and a photosensitive layer on the surface of the photoreceptor is abraded. When a remaining film thickness of the photosensitive layer is less than a lower limit to form the image, the life of the photoreceptor ends. Therefore, conventionally, various methods for measuring the thickness of the photosensitive layer (i.e., film thickness) have been proposed (e.g., see JP 2003-287409 A).

As is well known, when the surface of a photoreceptor is cleaned, a portion on which a toner image is formed is abraded more than a portion on which the toner image is not formed (i.e., non-image portion). In repeated printing, image coverage and/or paper sheet size is generally different each time. As mentioned above, the photoreceptor comes to have an uneven film thickness thereon. Since charging bias voltage is adjusted based on the uneven film thickness, a portion having a large film thickness may have image defect due to charging failure. Such image defect may end the life of the photoreceptor, although the photoreceptor has a sufficient remaining film thickness.

SUMMARY OF THE INVENTION

An object of the present invention is to provide an image forming apparatus with which the life of a photoreceptor can be extended regardless of a toner image forming history.

To achieve the above-mentioned object, according to an aspect, an image forming apparatus reflecting one aspect of the present invention comprises a photoreceptor rotatable about an axis, and having a surface with a photosensitive layer abraded during use, a charging unit configured to charge the surface of the photoreceptor, an exposure unit configured to form an electrostatic latent image on the surface of the photoreceptor, a developing unit configured to form a toner image on the surface of the photoreceptor, and a control unit configured to obtain a film thickness of the photosensitive layer for each of a plurality of different positions in a direction of a rotation axis of the photoreceptor, and perform abrasion operation at a predetermined first or second position of the photosensitive layer, when a difference in film thickness between the first position and the second position exceeds a predetermined reference value.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
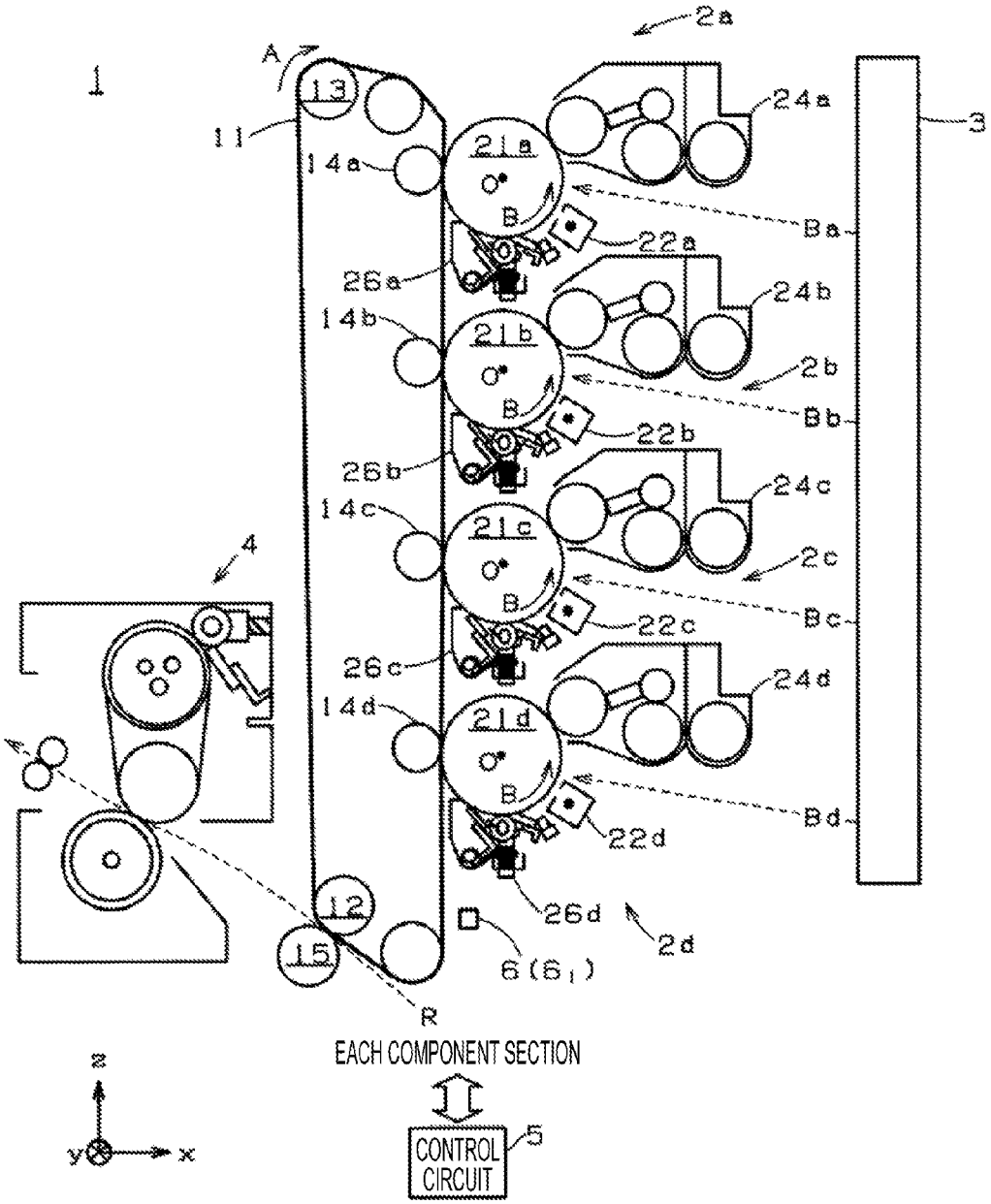
FIG. 1 is a schematic diagram illustrating a configuration of an image forming apparatus according to each embodiment.

Hereinafter, an embodiment of the present invention will be described with reference to the drawings. However, the scope of the invention is not limited to the illustrated examples.

First Embodiment

An image forming apparatus according to the present embodiment will be described below with reference to the drawings.

INTRODUCTION

First, description will be made of an x-axis, a y-axis, and a z-axis illustrated in several figures. The x-axis, the y-axis, and the z-axis are perpendicular to each other. The x-axis, the y-axis, and the z-axis indicate a right and left direction, a front and back direction, and a vertical direction of the image forming apparatus 1, respectively. Additionally, the y-axis indicates a direction in which a rotation axis of a photoreceptor drum 21 extends.

Further, in the drawings and the following description, small alphabet letters a, b, c, and d following reference signs are subscripts representing yellow (Y), magenta (M), cyan (C), and black (Bk), respectively. For example, the photoreceptor drum 21*a* represents the photoreceptor drum 21 for yellow color. Further, description of mere photoreceptor drum 21 without the subscript represents the photoreceptor drum 21 for each color.

<Configuration of Main Section of Image Forming Apparatus>

In FIG. 1, the image forming apparatus 1 is, for example, a tandem full-color multifunction peripheral (MFP) of electrophotographic type. The image forming apparatus 1 includes an intermediate transfer belt 11. The intermediate transfer belt 11 is wound around the outer peripheral parts of a roller 12, a tension roller 13, and the like generally disposed to be aligned in a vertical direction. The rollers 12 and 13 have rotation axises which extend in a front and back direction, and each of the rotation axises is rotated about an axis in a direction indicated by an arrow A, and the intermediate transfer belt 11 is also rotationally driven clockwise as indicated by the arrow A.

On the right side of the intermediate transfer belt 11, imaging units 2*a* to 2*d* are disposed downward from the upper side in this order. Each imaging unit 2 has the photoreceptor drum 21 for corresponding color. Each photoreceptor drum 21 has a cylindrical shape extending in a front and back direction. On the peripheral surface of the photoreceptor drum 21, a photosensitive layer having a film thickness abraded during use is formed. The photoreceptor drum 21 is rotated for example counterclockwise about an axis O of itself as indicated by an arrow B. In addition, around the photoreceptor drums 21*a* to 21*d*, charging units 22*a* to 22*d*, developing units 24*a* to 24*d*, and cleaning units 26*a* to 26*d* are disposed sequentially along their rotation directions B.

Further, primary transfer rollers 14*a* to 14*d* are provided at positions opposite to the photoreceptor drums 21*a* to 21*d* across the intermediate transfer belt 11. The primary transfer rollers 14*a* to 14*d* are urged toward the photoreceptor drums 21*a* to 21*d*, and therefore, primary transfer regions are formed one by one between respective primary transfer rollers 14*a* to 14*d* and the intermediate transfer belt 11. Additionally, a secondary transfer roller 15 is brought into press-contact with the intermediate transfer belt 11, at a position opposite to the roller 12 across the intermediate transfer belt 11. A secondary transfer region is formed between the secondary transfer roller 15 and the intermediate transfer belt 11.

Further, an exposure unit 3 is provided on the right side of the imaging units 2*a* to 2*d*.

Further, a paper feed cassette, not illustrated, on which sheets (paper sheets or OHP sheets) are loaded is disposed at the lower stage of the image forming apparatus 1. The paper feed cassette includes a paper feed roller, and the paper feed roller feeds respective sheets one by one to a conveying path R indicated by a dotted arrow. The conveying path R is provided thereon with a timing roller pair, the secondary transfer region, and a fixing unit 4, which are not illustrated.

Further, the image forming apparatus 1 includes a control circuit 5. The control circuit 5 includes, for example, a CPU, a non-volatile memory, and a main memory. The CPU executes a program stored in the non-volatile memory in the main memory, and controls the above-mentioned configurations. Although detailed description will be made later, the control circuit 5 derives the film thickness of the photosensitive layer of each photoreceptor drum 21 at different positions in the y-axis direction, and then, abrasion operation of the photoreceptor drum 21 is controlled for each photoreceptor drum 21, based on a plurality of derived film thicknesses.

<Normal Printing Operation of Image Forming Apparatus>

In the image forming apparatus 1, the charging units 22*a* to 22*d* uniformly charge the surfaces of the photoreceptor drums 21*a* to 21*d* for corresponding colors (charging step). The exposure unit 3 irradiates the charged surfaces of the photoreceptor drums 21*a* to 21*d* with light beams Ba to Bd for corresponding colors, and forms electrostatic latent images of corresponding colors (exposing step). Here, the light beams Ba to Bd are modulated by data representing an image which a user desires to print (hereinafter, referred to as an image to be printed). Further, the light beams Ba to Bd may be modulated by data representing a half-tone image, for abrasion operation. The developing units 24*a* to 24*d* feed toner onto the surfaces of the photoreceptor drums 21*a* to 21*d* supporting electrostatic latent images of corresponding colors, and form toner images for corresponding colors on the surfaces of the photoreceptor drums 21*a* to 21*d* (developing step). Next, the toner images supported on the respective photoreceptor drums 21*a* to 21*d* are sequentially transferred and superposed on the outer peripheral surface of the intermediate transfer belt 11 in the primary transfer regions for corresponding colors, and thereby a full-color composite toner image is formed on the intermediate transfer belt 11 (primary transfer). The composite toner image is conveyed to the secondary transfer region while being supported on the intermediate transfer belt 11.

Here, the toner which has not been transferred to the intermediate transfer belt 11 remains on the surfaces of the respective photoreceptor drums 21*a* to 21*d*. The remaining untransferred toner is conveyed toward the cleaning units 26*a* to 26*d* for corresponding colors, by the rotation of the photoreceptor drums 21*a* to 21*d*. The cleaning units 26*a* to 26*d* are provided on the circumferential surfaces of the photoreceptor drums 21*a* to 21*d* for corresponding colors, on the downstream side of the rotation direction B relative to the primary transfer regions. The cleaning units 26*a* to 26*d* scrape and collect the remaining untransferred toner on the photoreceptor drums 21*a* to 21*d* for corresponding colors (cleaning step). The collected toner is collected from the cleaning units 26*a* to 26*d* for the corresponding colors into a waste toner box not illustrated.

Further, the electrostatic latent images remaining on the surfaces of the photoreceptor drums 21*a* to 21*d* are wholly exposed by static eliminators and erased. Here, each of the static eliminators is a light emitting element array. The light emitting element arrays are provided between the cleaning units 26*a* to 26*d* for corresponding colors and the charging units 22*a* to 22*d* along the rotation direction B, respectively. The light emitting element array has a plurality of light emitting elements disposed in the depth direction. The static eliminators are configured to irradiate the surfaces of the photoreceptor drums 21*a* to 21*d* for corresponding colors with light, and an image history (memory image) is removed in order to form a next image.

Further, the sheet having been fed from the paper feed cassette is conveyed on the conveying path R, and abuts on the timing roller pair (not illustrated) being stopped. Thereafter, the timing roller pair starts to rotate in synchronization with transfer timing in the secondary transfer region, and feeds the sheet temporarily stopped to the secondary transfer region.

In the secondary transfer region, the roller 12 and the secondary transfer roller 15 transfer the composite toner image on the intermediate transfer belt 11 onto the sheet introduced from the timing roller pair (secondary transfer). The sheet having been subjected to the secondary transfer is fed to the downstream of the conveying path R by the secondary transfer roller 15 and the intermediate transfer belt 11.

The fixing unit 4 has a fixing roller and a pressure roller. The sheet having been fed from the secondary transfer region is introduced into a nip formed between the rollers. The fixing roller heats the toner image on the sheet passing through the nip, and simultaneously, the pressure roller presses the sheet. Therefore, a full-color toner image is fixed on the sheet. Thereafter, the fixing roller and the pressure roller feed the sheet on which the toner image has been fixed to the downstream of the conveying path R. The fed sheet is output to an output tray through exit rollers not illustrated.

<About Details of Abrasion Operation>

In the image forming apparatus 1, the abrasion operation is performed in order to solve the technical problem having been described in "Technical Problem". The present technical problem will be described below in detail.

As is well known, in the electrophotographic image forming apparatus, toner remaining on a photoreceptor drum serves as an abrasive during cleaning by a cleaning unit. Therefore, during cleaning, a portion on which the toner image is formed is abraded more greatly than the other portion, in a photosensitive layer of each photoreceptor drum. Further, image coverage and/or paper sheet size is often different each time normal printing is performed. Accordingly, repeated normal printing brings about a difference in film thickness in a direction of a rotation axis of the photoreceptor drum between photosensitive layers.

Incidentally, as is well known, charging bias is applied to each charging unit. The absolute value of potential of the charging bias is set smaller based on an average film thickness in the y-axis direction with the abrasion of the film thickness. Accordingly, in a charging step, charging failure is generated in a photosensitive layer portion having a thickness larger than the average film thickness, and further, image defect is generated in the photosensitive layer portion. When the image defect is generated, the life of the photoreceptor drum ends earlier than expected, even when the photoreceptor drum has a sufficient film thickness. As the results of experiments and studies, the present inventors have found that the end of the life caused by the image defect may occur when the film thickness is larger by approximately 5 μm to 10 μm with respect to the average film thickness.

In order to prevent the image defect caused by the charging failure, the absolute value of the potential of the charging bias may be adjusted based on a portion having a large film thickness. However, with this method, a portion having a small film thickness has an excessive electric charge, abrasion of the photosensitive layer is accelerated rapidly, and the life of the photoreceptor drum is reduced.

Figure 2:
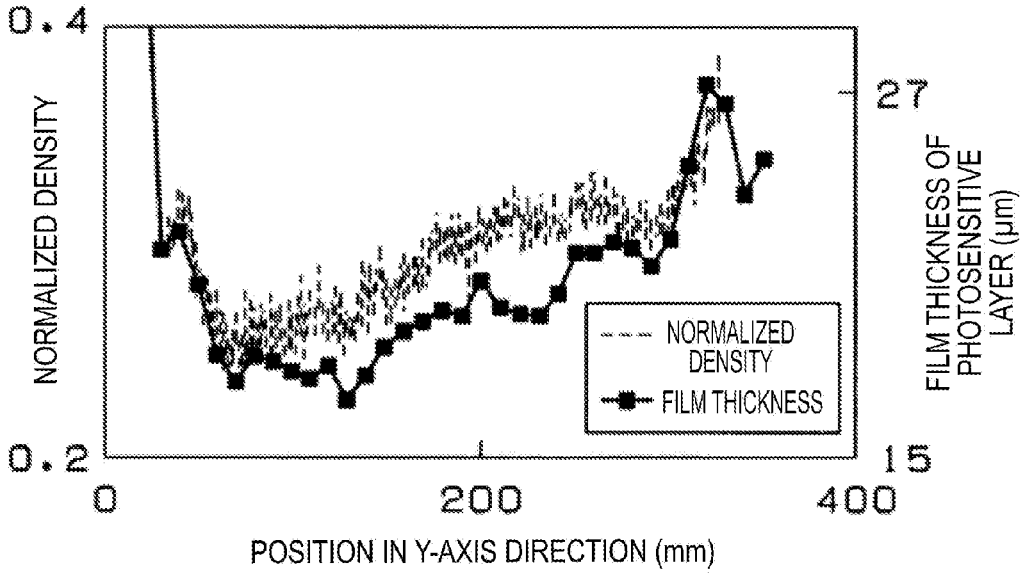
FIG. 2 is a graph illustrating a density value (dashed line) and a film thickness (solid line) of a half-tone image on a sheet at each position of a photoreceptor drum in the y-axis direction.

Therefore, an image forming apparatus capable of extending the life of a photoreceptor drum regardless of a toner image forming history has been demanded. As the results of experiments and studies having been conducted in order to solve the technical problem as mentioned above, the present inventors have obtained the knowledge that the density in the y-axis direction of a half-tone image or the like formed on the sheet, the photoreceptor drum, or the intermediate transfer belt is correlated with film thickness of the photosensitive layer. FIG. 2 is a graph illustrating a density value (dashed line) and a film thickness (solid line) of the half-tone image on the sheet at each position of the photoreceptor drum in the y-axis direction. According to FIG. 2, it is clear that the density value is correlated with the film thickness.

Figure 3:
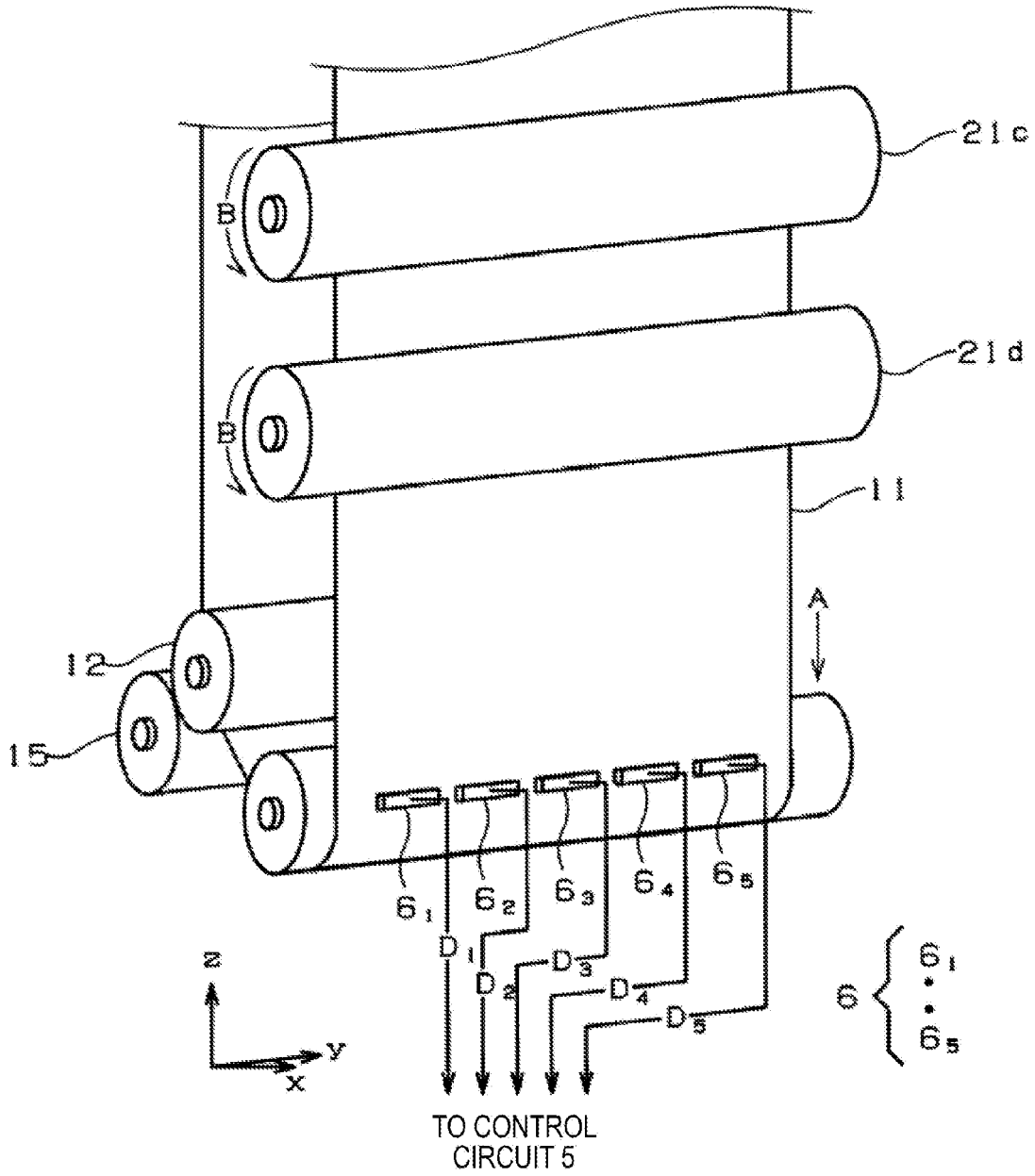
FIG. 3 is a schematic view illustrating toner density sensors of the image forming apparatus of FIG. 1.

In order to obtain a half-tone density as described above, the present image forming apparatus 1 includes a plurality of toner density sensors 6, as illustrated in FIG. 3. FIG. 3 exemplifies five toner density sensors $\mathbf{6}_1$ to $\mathbf{6}_5$. The toner density sensors $\mathbf{6}_1$ to $\mathbf{6}_5$ are disposed at positions separated by a predetermined distance in a normal direction from, for example, the outer peripheral surface of the intermediate transfer belt 11, between the photoreceptor drum 21*d* and the secondary transfer region, to be different in position in the y-axis direction. More specifically, the toner density sensors $\mathbf{6}_1$ and $\mathbf{6}_5$ are opposed to the front and rear ends of the photoreceptor drum 21, respectively, and the toner density sensor $\mathbf{6}_3$ is opposed to substantially the center of the photoreceptor drum 21. The toner density sensor $\mathbf{6}_2$ is opposed to an intermediate position between the front end and the center of the photoreceptor drum 21, and the toner density sensor $\mathbf{6}_4$ is opposed to an intermediate position between the rear end and the center of the photoreceptor drum 21.

The toner density sensors $\mathbf{6}_1$ to $\mathbf{6}_5$ are a type of measuring for example the intensity of reflected light in a non-contact manner. Specifically, under the control of the control circuit 5, each of the toner density sensors $\mathbf{6}_1$ to $\mathbf{6}_5$ irradiate the half-tone image on the intermediate transfer belt 11 with light having a predetermined light intensity, and output signals (hereinafter, referred to as merely density, for convenience) $D_1$ to $D_5$ to the control circuit 5. Each of the signal has a level correlated with a light intensity of reflected light from the half-tone image, or a density on the photoreceptor drum 21 for corresponding color.

Figure 4:
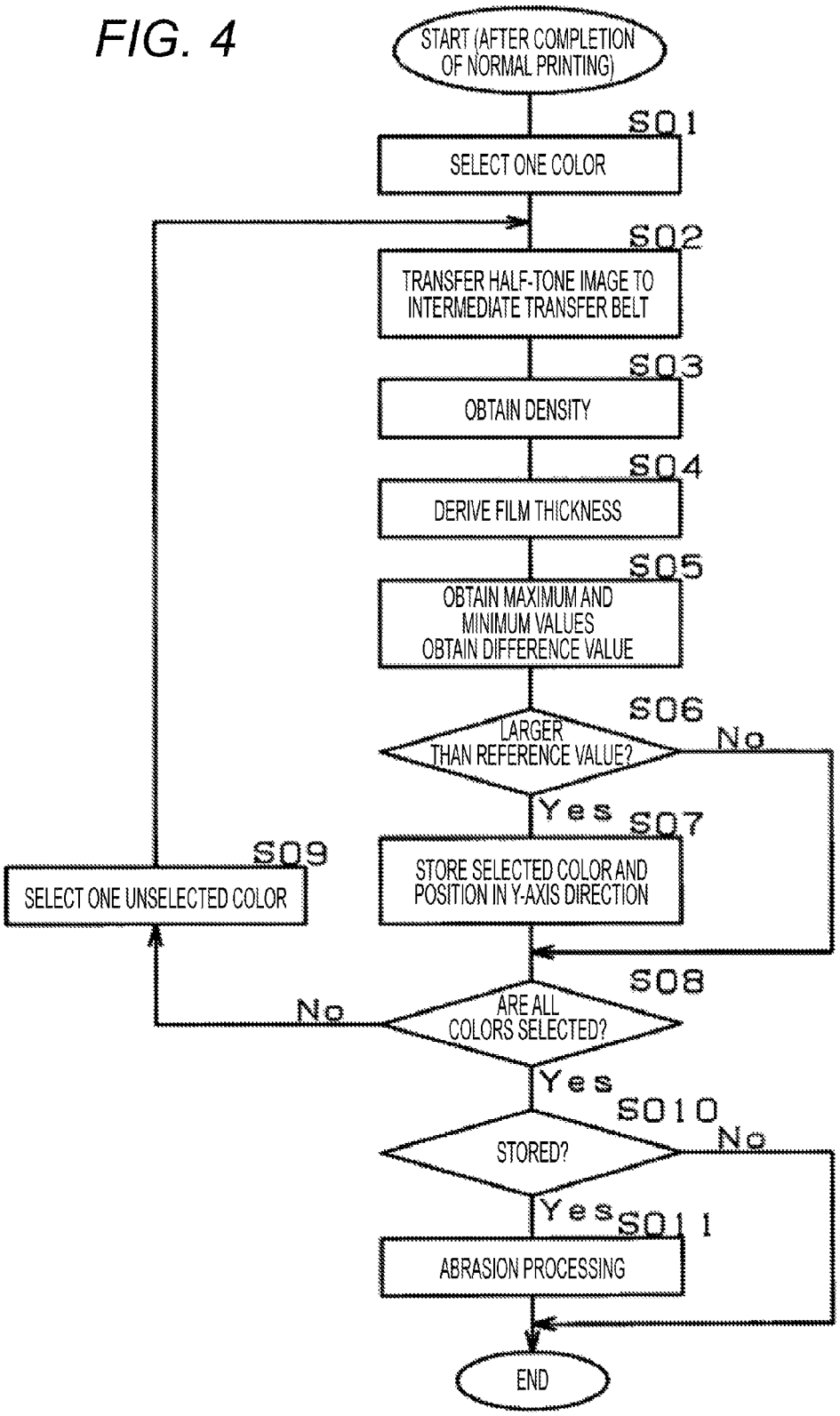
FIG. 4 is a flowchart illustrating abrasion operation performed in the image forming apparatus of FIG. 1.

The control circuit 5 performs the abrasion operation illustrated in FIG. 4 based on the densities $D_1$ to $D_5$. In FIG. 4, for example, the control circuit 5 controls each section to select one color from four YMCK colors, after normal printing operation (S01), form the toner image representing the half-tone image of the selected color, and transfer the toner image onto the intermediate transfer belt 11 (S02). The toner image has a width corresponding to a width in the y-axis direction of a printing area of the photosensitive layer.

Next, the control circuit 5 operates the toner density sensors $\mathbf{6}_1$ to $\mathbf{6}_5$ for corresponding colors. The toner density sensors $\mathbf{6}_1$ to $\mathbf{6}_5$ emit light having a predetermined light intensity to the toner image (i.e., the half-tone image) on the intermediate transfer belt 11, and receives the reflected light, respectively. Then, the toner density sensors $\mathbf{6}_1$ to $\mathbf{6}_5$ output the densities $D_1$ to $D_5$ at positions corresponding to the respective sensors in the y-axis direction, to the control circuit 5 (S03).

As described above, since the density is correlated with the film thickness, the control circuit 5 multiplies the input densities $D_1$ to $D_5$ by a predetermined coefficient, and derives film thicknesses $t_1$ to $t_5$ at respective corresponding positions in the y-axis direction (S04). It is noted that the predetermined coefficient is previously determined by an experiment or the like.

Next, the control circuit 5 selects a maximum value $t_{max}$ and a minimum value $t_{min}$ from the derived film thicknesses $t_1$ to $t_5$, and determines a difference value $\Delta$ ($=t_{max}-t_{min}$) as one example of a difference in film thickness at respective positions in first and second axis directions (S05).

Next, the control circuit 5 determines whether the difference value $\Delta$ exceeds a predetermined reference value $t_{th}$ (S06). Here, the reference value $t_{th}$ is set to for example 3 μm. If No in step S06, the control circuit 5 skips step S07, and performs step S08.

Whereas, if Yes in step S06, the control circuit 5 stores the currently selected color (i.e., the photoreceptor drum 21 having a high probability of charging failure), and the position in the y-axis direction representing a current maximum value $t_{max}$ (i.e., the position in the y-axis direction having a high probability of charging failure) (S07).

Next, the control circuit 5 determines whether all of the four colors are selected (S08), and if Yes in step S08, the control circuit 5 performs step S010 mentioned below. Whereas, if No in step S08, the control circuit 5 selects one unselected color (S09), and performs step S02.

After the processes of steps S01 to S09 are performed for all colors, that is, after Yes in step S08, the control circuit 5 determines whether at least one set of the photoreceptor drum 21 having a high probability of charging failure and the position in the y-axis direction is stored (S010). If No in step S010, the control circuit 5 finishes the processing of FIG. 4.

Whereas, if Yes in step S010, the control circuit 5 performs abrasion processing in the next normal printing operation (S011). More specifically, the control circuit 5 forms the toner image at the position in the y-axis direction of the photosensitive layer having a high probability of charging failure, between two successive toner images representing printed images (so-called an inter-sheet gap), based on the photoreceptor drum 21 and the position in the y-axis direction which are currently stored. The toner image is scraped and collected by the cleaning unit 26 for corresponding color without being transferred onto the intermediate transfer belt 11. Here, the toner image serves as the abrasive, and the cleaning unit 26 scrapes the abrasive to abrade the photosensitive layer.

<Function and Effect of Abrasion Operation>

As described above, according to the present image forming apparatus 1, in the photoreceptor drum 21 for each color, the photosensitive layer portion having a large film thickness is specified, which has a probability of charging failure, and the portion is subjected to the abrasion processing. Therefore, the image forming apparatus 1 can be provided, capable of extending the life of the photoreceptor drum 21 regardless of the toner image forming history.

Appendix 1

In the above-mentioned embodiment, the image forming apparatus 1 has been described as the full-color MFP. However, the image forming apparatus 1 is not limited to this embodiment, and may be a printer, a facsimile machine, or a copying machine.

Appendix 2

In the above-mentioned embodiment, the toner density sensor 6 has been described to measure the intensity of the reflected light. However, the toner density sensor 6 is not limited to this embodiment, and may be measure transmitted light intensity.

Appendix 3

In the above-mentioned embodiment, step S01 of FIG. 4 has been described to be performed after the normal printing operation. However, step S01 is not limited to this embodiment, and the abrasion operation of FIG. 4 may be started at another timing. Further, in the above-mentioned embodiment, step S011 of FIG. 4 has been described to be performed over an inter-sheet gap. However, step S011 of FIG. 4 is not limited to this embodiment, and step S011 may be also performed at another timing. However, the start of the abrasion operation after the normal printing operation or the performance of step S011 over an inter-sheet gap prevents the image forming apparatus 1 from being abruptly operated only for the abrasion operation, and it is desirable because the user does not feel uncomfortable.

Appendix 4

In the above-mentioned embodiment, step S05 of FIG. 4 has been described in which the maximum value $t_{max}$ and the minimum value $t_{min}$ are selected. However, step S05 is not limited to this embodiment, and the second largest value may be selected in place of the maximum value $t_{max}$, and the second smallest value in place of the minimum value $t_{min}$.

Appendix 5

In the above-mentioned embodiment, the toner density sensor 6 has been described to detect the density of the composite toner image on the intermediate transfer belt 11. However, the toner density sensor 6 is not limited to this embodiment, and the toner density sensor 6 may be configured to detect the density of the toner image on the sheet fed from the fixing unit 4.

Second Embodiment

An image forming apparatus according to the present embodiment has a configuration almost the same as the configuration of FIG. 1, and FIG. 1 is employed in the following description. FIG. 1 is also employed for the following third to seventh embodiments.

Figure 5:
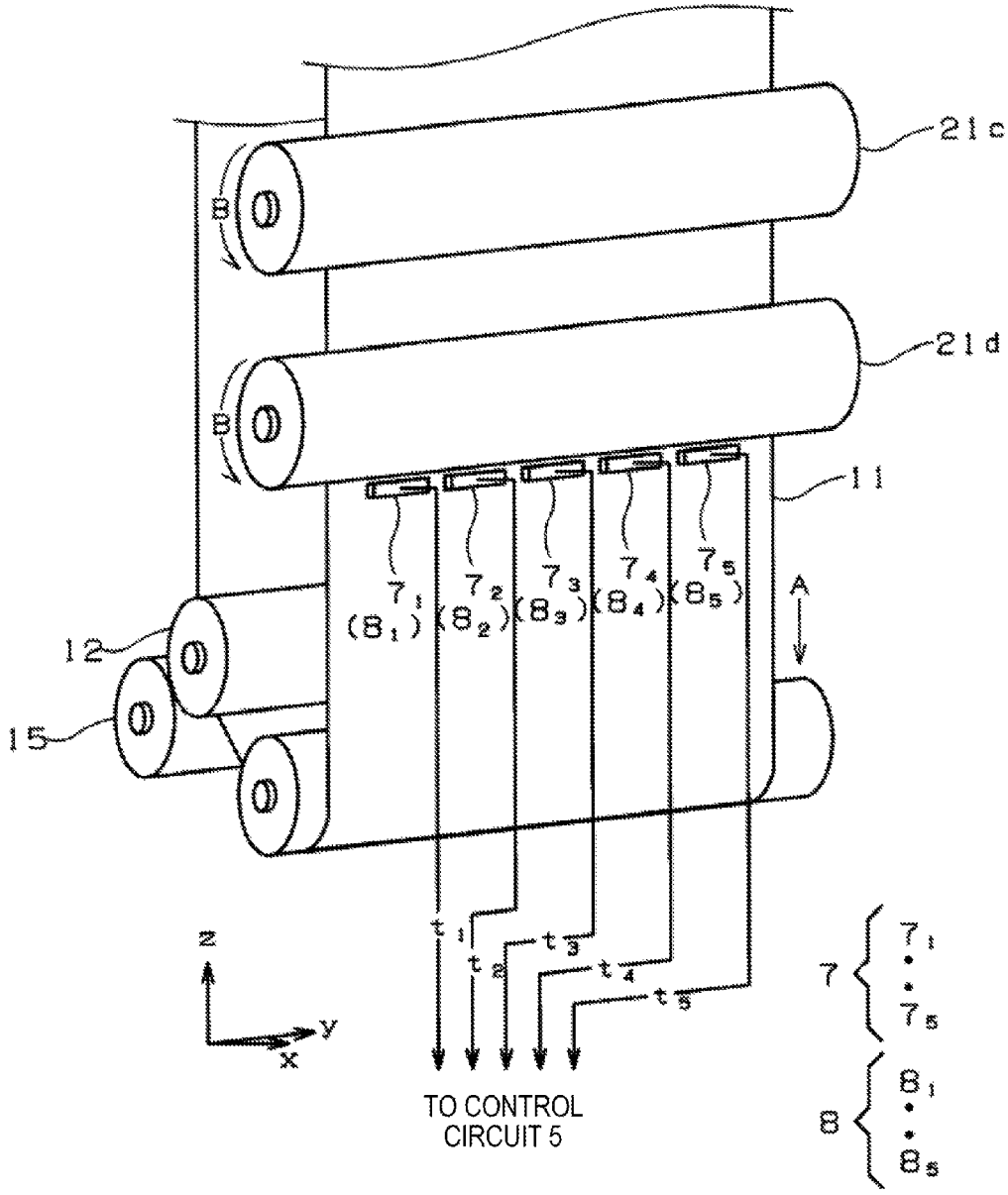
FIG. 5 is a schematic diagram illustrating contact film thickness meters and optical film thickness meters according to second and third embodiments.

As illustrated in FIG. 5, the image forming apparatus 1 according to the present embodiment is different from the image forming apparatus 1 according to the first embodiment in that a plurality of contact film thickness meters 7 is provided for each color, in place of the toner density sensors 6. There is no difference between both image forming apparatuses 1 in configuration other than the plurality of contact film thickness meters. It is noted that, in FIG. 5, five contact film thickness meters 7*d* for black color are illustrated, as a representative of all four colors.

Figure 6:
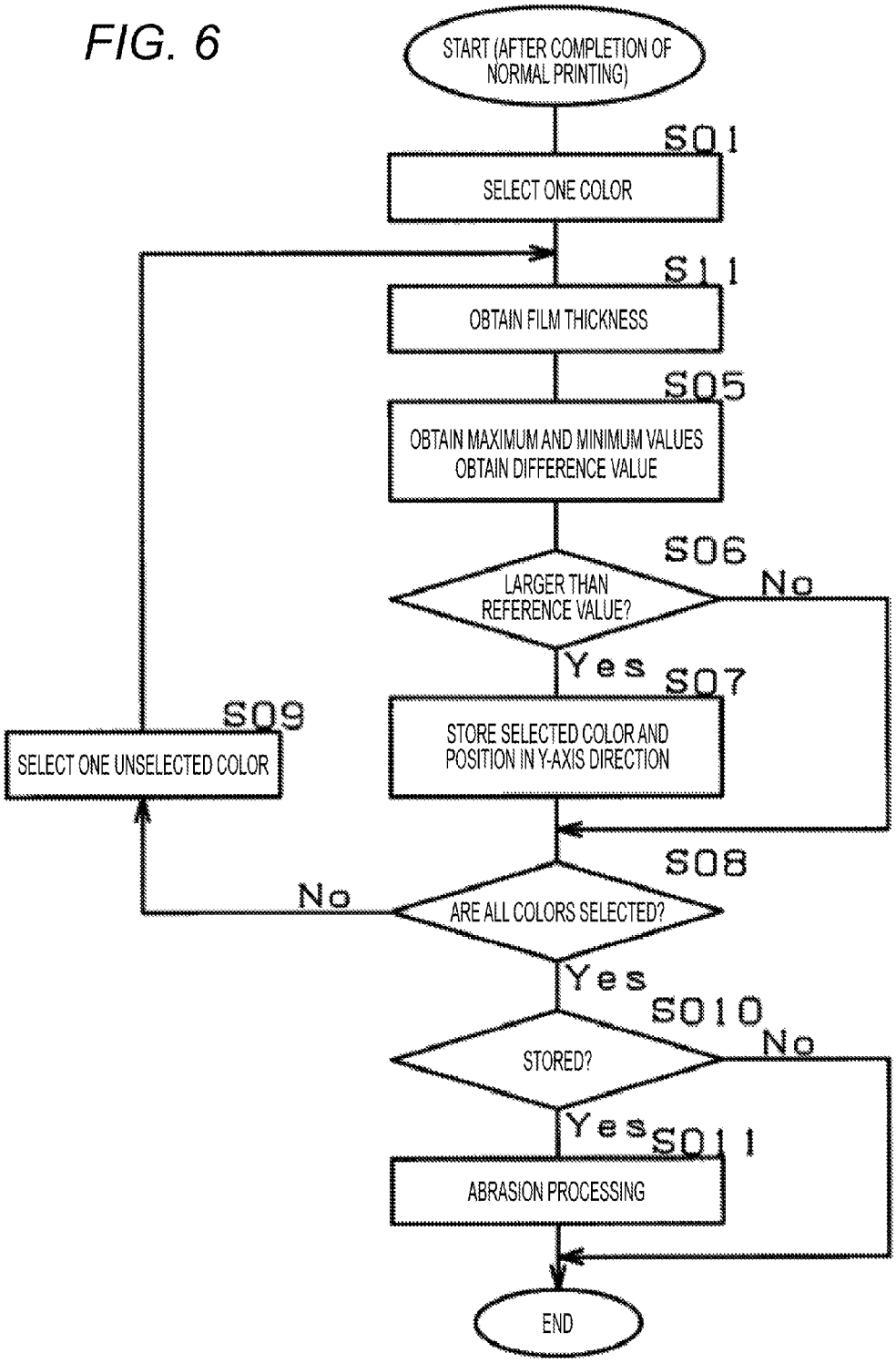
FIG. 6 is a flowchart illustrating abrasion operation performed in an image forming apparatus according to a third embodiment.

Abrasion operation of the image forming apparatus 1 according to the present embodiment will be described. The present abrasion operation is different from the abrasion operation of FIG. 4 only in that a control circuit 5 performs step S11 in place of steps S02 to S04, to obtain film thicknesses $t_1$ to $t_5$ corresponding to respective positions in the y-axis direction from the contact film thickness meters 7 for selected color (see FIG. 6).

Third Embodiment

As illustrated in FIG. 5, the image forming apparatus 1 according to the present embodiment is different from the image forming apparatus 1 according to the first embodiment in that a plurality of optical film thickness meters 8 is provided for each color, in place of the toner density sensors 6. There is no difference between both image forming apparatuses 1 in configuration other than the plurality of optical film thickness meters. It is noted that, in FIG. 5, five non-contact film thickness meters 8*d* for black color are illustrated, as a representative of all four colors.

Abrasion operation of the image forming apparatus 1 according to the present embodiment will be described. The present abrasion operation is different from the abrasion operation of FIG. 4 only in that a control circuit 5 performs step S11 of FIG. 6 in place of steps S02 to S04, to obtain film thicknesses $t_1$ to $t_5$ corresponding to respective positions in the y-axis direction from the optical film thickness meters 8 for selected color.

Fourth Embodiment

Figure 7:
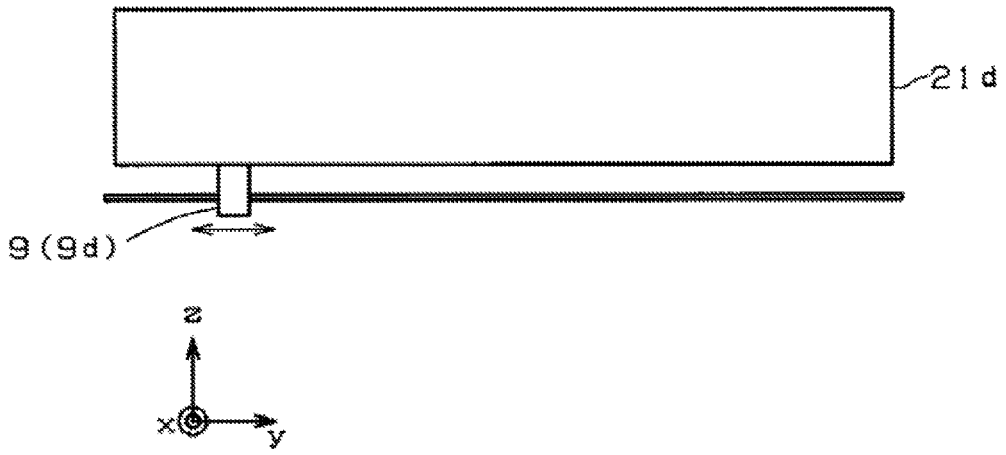
FIG. 7 is a schematic diagram illustrating a partial abrasion member of an image forming apparatus according to a fourth embodiment.

As illustrated in FIG. 7, an image forming apparatus 1 according to the present embodiment is different from the image forming apparatuses 1 according to the above-mentioned embodiments in configuration in that a partial abrasion member 9 for each color is further provided. There is no difference between both image forming apparatuses 1 in configuration other than the partial abrasion member. It is noted that, in FIG. 7, the partial abrasion member 9*d* for black color is illustrated, as a representative of all four colors.

The partial abrasion member 9 is a cleaning blade having a front end portion capable of abutting on the surface of the photoreceptor drum 21 for corresponding color, and is provided on the downstream side from a cleaning unit 26 for corresponding color in a rotation direction B, and on the upstream side from a charging unit 22 for corresponding color. The front end of the cleaning blade has a width narrowed in the y-axis direction compared with that of the cleaning unit 26. Further, the cleaning blade is configured to be movable in the y-axis direction under the control of the control circuit 5.

Further, in step S011 of FIG. 4, the control circuit 5 disposes the partial abrasion member 9 at each position in the y-axis direction of the photosensitive layer having a high probability of charging failure, based on the photoreceptor drum 21 and the position in the y-axis direction which are currently stored. Therefore, the partial abrasion member 9 locally abrades a portion on which the cleaning blade abuts, in the photosensitive layer of the photoreceptor drum 21 for corresponding color.

In the present embodiment, the partial abrasion member 9 has been described to abrade the photosensitive layer over an inter-sheet gap. However, the partial abrasion member is not limited to this embodiment, and may abrade the photosensitive layer at the timing other than an inter-sheet gap.

Further, the partial abrasion member 9 may be a cleaning brush in place of the cleaning blade.

Fifth Embodiment

In step S011 of FIG. 4, an image forming apparatus 1 according to the present embodiment is different from the image forming apparatuses according to the above-mentioned embodiments only in that relatively large charging bias voltage (i.e., charging bias voltage larger than that in forming a printed image) is used to form a toner image over an inter-sheet gap.

Sixth Embodiment

Figure 8:
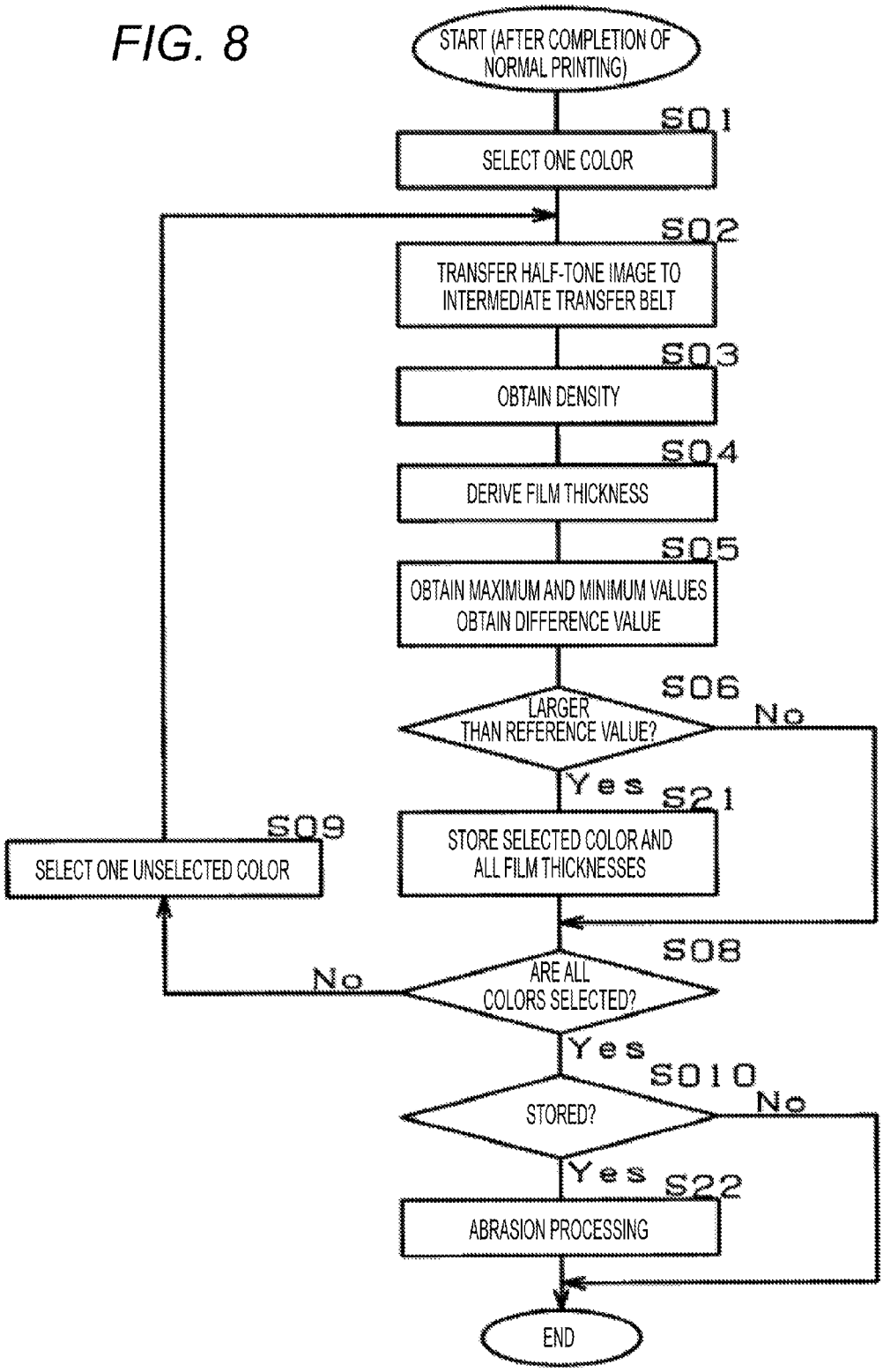
FIG. 8 is a flowchart illustrating abrasion operation performed in an image forming apparatus according to a sixth embodiment.

An image forming apparatus 1 according to the present embodiment is different from the image forming apparatus according to the first embodiment in that abrasion operation illustrated in FIG. 8 is performed. FIG. 8 is different from FIG. 4 only in that steps S21 and S22 are included in place of steps S07 and S011. There is no difference between FIG. 4 and FIG. 8 other than the steps. Therefore, in FIG. 8, steps corresponding to the steps of FIG. 4 are designated with the same step numbers, and their description will be omitted.

In step S21 of FIG. 8, a control circuit 5 stores a currently selected color, and all film thicknesses $t_1$ to $t_5$ having been derived.

Further, in step S22, the control circuit 5 forms a toner image having a toner density correlated with the corresponding film thicknesses $t_1$ to $t_5$ for each currently-stored photoreceptor drum 21. The toner image is scraped and collected by the cleaning unit 26 for corresponding color without being transferred onto the intermediate transfer belt 11. Here, the toner image serves as the abrasive, and the cleaning unit 26 scrapes the abrasive to abrade the photosensitive layer.

Seventh Embodiment

An image forming apparatus 1 according to the present embodiment is different from the image forming apparatus according to the first embodiment in that the fifth embodiment and the sixth embodiment are combined.

Comparison Between First to Seventh Embodiments

The present inventors modified a following multifunction printer to experimentally produce the image forming apparatuses 1 according to the first to seventh embodiments, and confirmed the effects of the image forming apparatuses.

Multifunction printer: bizhub PRO C554 (Konica Minolta, Inc.)

Printing mode: tandem

Laser beam wavelength: 780 nm

Developing method: reversal development

Charging method: roller charging

Further, the present inventors experimentally produced the same multifunction printer as a comparative example, excluding non-performance of film thickness measurement and abrasion operation as in the above-mentioned embodiments.

The present inventors repeated a process of forming an A4-size image including two regions of an image portion having a printing area ratio of 100%, and a non-image portion having a printing area ratio of 0% for each of Y, M, C, and Bk colors, superposing the image on an A4-size acid-free paper, and making printed matter, using each experimental image forming apparatus 1.

Further, the present inventors defined the life of a photoreceptor drum 21 as follows. That is, the life of the photoreceptor drum 21 was defined based on the repeated printing having been described above, to have the number of printed sheets obtained until a film thickness of a photosensitive layer of the photoreceptor drum 21 is less than a lower limit sufficient to form an image, or until a difference between a maximum value and a minimum value of the film thickness of the photosensitive layer (i.e., a difference in film thickness) is more than 10 μm.

Figure 9:
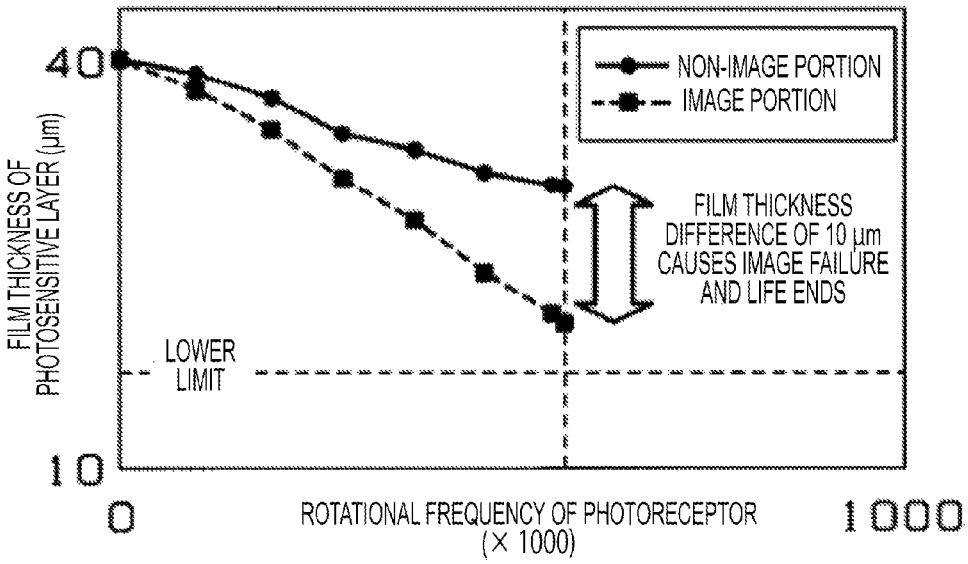
FIG. 9 is a graph illustrating film thickness against rotational frequency of a photoreceptor drum according to a comparative example.
Figure 10:
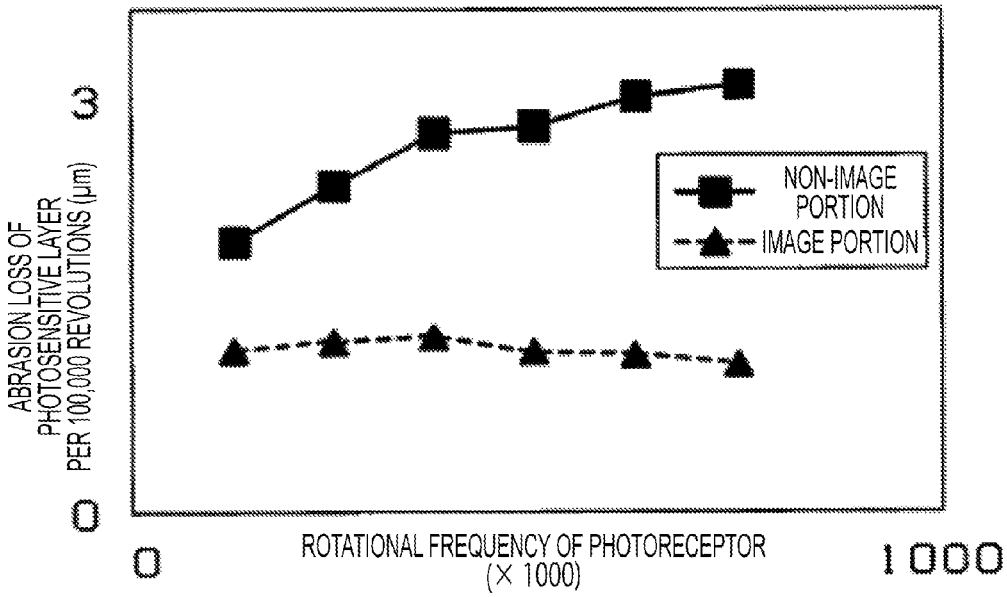
FIG. 10 is a graph illustrating film thickness with respect to rotational frequency of the photoreceptor drum for each of an image portion and the non-image portion according to the comparative example.
Figure 11:
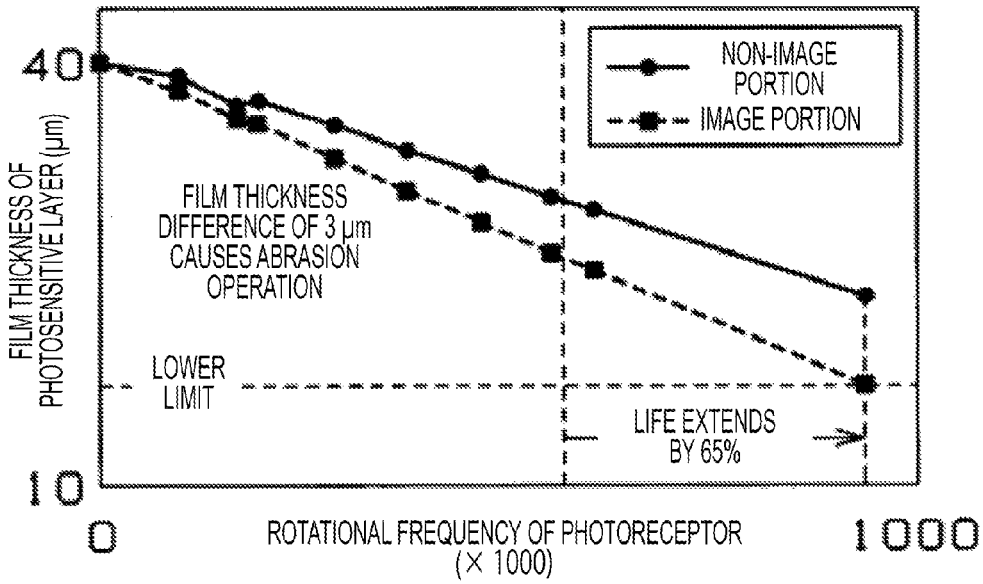
FIG. 11 is a graph illustrating film thickness with respect to rotational frequency of the photoreceptor drum according to the first embodiment.

First, when the comparative example is used, the film thickness was reduced until the end of the life of the photoreceptor drum, as illustrated in FIG. 9. At that time, the film thicknesses in the image portion and the non-image portion were abraded as illustrated in FIG. 10. In contrast, when the image forming apparatus 1 of the first embodiment is used, the film thickness was reduced until the end of the photoreceptor drum 21, as illustrated in FIG. 11. As can be seen from the comparison between FIG. 9 and FIG. 11, the life of the photoreceptor drum of the comparative example ends, since a difference in film thickness reaches 10 μm, when the rotational frequency of the photoreceptor drum exceeds approximately 500,000 revolutions. However, it can be seen that the life of the image forming apparatus 1 of the first embodiment is extended by approximately 65% with respect to the comparative example.

The present inventors also similarly measured the extension rate of the life of the photoreceptor drum relative to the comparative example, for the second to seventh embodiments. The results are illustrated in the following table 1.

TABLE 1

Life extension ratios of embodiments

| | Film thickness measurement method | Abrasion operation | Voltage control | Control of toner amount correlated with film thickness | Life extension ratio (%) |
|---|---|---|---|---|---|
| Comparative example | Not done | Not done | Not done | Not done | 100 |
| First embodiment | Indirect measurement (toner density) | Inter-sheet gap | Not done | Not done | 165 |
| Second embodiment | Contact film thickness measurement | Inter-sheet gap | Not done | Not done | 160 |
| Third embodiment | Optical film thickness measurement | Inter-sheet gap | Not done | Not done | 165 |
| Fourth embodiment | Indirect measurement (toner density) | Partial abrasion member | Not done | Not done | 120 |
| Fifth embodiment | Indirect measurement (toner density) | Partial abrasion member | Done | Not done | 170 |
| Sixth embodiment | Indirect measurement (toner density) | Partial abrasion member | Not done | Done | 170 |
| Seventh embodiment | Indirect measurement (toner density) | Partial abrasion member | Done | Done | 180 |

An image forming apparatus according to an embodiment of the present invention can extend the life of a photoreceptor regardless of a toner image forming history, and is suitable for a printer, a facsimile machine, a copying machine, an MFP having integrated their functions, or the like.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a photoreceptor rotatable about an axis, and having a surface with a photosensitive layer abraded during use;

a charging unit configured to charge the surface of the photoreceptor;

an exposure unit configured to form an electrostatic latent image on the surface of the photoreceptor;

a developing unit configured to form a toner image on the surface of the photoreceptor; and a control unit configured to obtain a film thickness of the photosensitive layer for each of a plurality of different positions in a direction of a rotation axis of the photoreceptor, and perform abrasion operation at a first or second position of the plurality of positions, when a difference in film thickness between the first position and the second position exceeds a predetermined reference value.

2. The image forming apparatus according to claim 1, wherein the first position is a position having a maximum film thickness of the photosensitive layer, and the second position is a position having a minimum film thickness of the photosensitive layer.

3. The image forming apparatus according to claim 1, further comprising an intermediate transfer belt configured to receive the transfer of the toner image having been formed on the photoreceptor, wherein the control unit obtains a density of the toner image on the intermediate transfer belt or the surface of the photoreceptor for each of the plurality of positions, and derives the film thickness of the photosensitive layer for each of the plurality of positions, based on the obtained density of the toner image.

4. The image forming apparatus according to claim 1, wherein the control unit performs abrasion operation with respect to the first position of the photosensitive layer during normal printing.

5. The image forming apparatus according to claim 1, wherein the charging unit charges the photoreceptor with a charging bias voltage having an absolute value larger than the absolute value during the normal printing, during the abrasion operation.

6. The image forming apparatus according to claim 1, wherein the developing unit forms, on the surface of the photoreceptor, a toner image having a relatively high density at the first position of the photosensitive layer, during the abrasion operation.

* * * * *